United States Patent [19]

Ueno et al.

[11] 3,961,883

[45] June 8, 1976

[54] PROCESS FOR PRINTING A FIBER PRODUCT CONTAINING ACRYLIC FIBERS AND CELLULOSIC FIBERS

[75] Inventors: Eichiro Ueno, Wakayama; Hideo Kawasaki, Moriyama; Syozo Shigita, Hirakata, all of Japan

[73] Assignee: American Cyanamid Company, Stamford, Conn.

[22] Filed: Oct. 31, 1973

[21] Appl. No.: 411,565

[52] U.S. Cl. ..... 8/21 A; 8/24; 8/25

[51] Int. Cl.[2] ..... D06P 3/87

[58] Field of Search ..... 8/21 A, 24, 25

[56] References Cited

UNITED STATES PATENTS

| | | | |
|---|---|---|---|
| 2,614,023 | 10/1952 | Olpin | 8/24 |
| 2,743,993 | 5/1956 | Rankin | 8/25 |
| 2,952,505 | 9/1960 | Carter | 8/21 A |
| 3,140,914 | 7/1964 | Ward | 8/24 |
| 3,377,128 | 4/1968 | Rafael | 8/21 A |
| 3,704,087 | 11/1972 | Feess | 8/25 |
| 3,788,805 | 1/1974 | Ookubo | 8/21 A |
| 3,807,945 | 4/1974 | Von der Eltz | 8/21 A |
| 3,843,319 | 10/1974 | Von der Eltz | 8/25 |

*Primary Examiner*—Paul R. Michl
*Attorney, Agent, or Firm*—William J. van Loo

[57] ABSTRACT

The invention is concerned with printing fabrics containing (a) acrylic fibers and/or modacrylic fibers having acidic dyesites but free of basic dyesites and (b) cellulosic fibers with a printing paste containing (A) an acid dye containing a single sulfonic acid group and having an inorganicity/organicity ratio below 4 for dyeing the acrylic or modacrylic fibers and (B) a direct or reactive dye for dyeing the cellulosic fibers.

10 Claims, No Drawings

PROCESS FOR PRINTING A FIBER PRODUCT CONTAINING ACRYLIC FIBERS AND CELLULOSIC FIBERS

This invention relates to a printing procedure for dyeing fiber products composed of a blend of acrylic and cellulose fibers. More particularly, the invention relates to such a process wherein the acrylic fiber has substantially no sites for anionic dyes, the printing paste contains an acid dye possessing a single sulfonic acid group and a specific ratio of inorganicity/organicity and a direct or reactive dye, and the printed fiber product is steamed to dye the acrylic fiber with said acid dye and the cellulose fiber with the selected direct or reactive dye.

Fiber products containing blends of commercially available acrylic and cellulose fibers are well known and may result from various blending techniques such as spinning the fiber blends into yarns from which the products are fabricated, weaving yarns of acrylic fiber with yarns of cellulose fiber, or knitting yarns of acrylic fiber with yarns of cellulose fiber. In such fiber products, it is known to employ as the acrylic fiber, one which contains substantially no sites for anionic dyes. When the fiber blend products of the latter variety are dyed, it is conventional practice to employ a dyebath containing a cationic dye for the acrylic fiber and an anionic dye for the cellulose fiber, in conformity with the requirements of the specific dyes employed. However, when dyes of different ionic types, i.e., cationic and anionic types, are present in the same dyebath, these dyes will form a complex and precipitate. This gives rise to uneven dyeing of the fiber product and makes it impossible to provide the product in the desired color. In addition, other problems arise such as loss of dyes, soiling of the dyeing equipment, and the like. For this reason, when dyeing products of such type with cationic and anionic dyes, it is necessary to employ a suitable anti-precipitant in the dyebath.

In conjunction with dyeing processes where the product of the fiber blend is to be printed with the combination of cationic and anionic dyes, problems arise due to the very high concentrations of dyes used in the printing and these problems are not corrected by use of anti-precipitants. The printed fiber product shows deep colored spots due to local concentrations of precipitates and the printing paste is unstable. Accordingly, in dyeing procedures where dye pastes are printed on the fiber products it has been considered technically unfeasible to employ dyes which exhibit ionic charges and resort is had to pigment printing, with full knowledge of its deficiencies, i.e., low color fastness to abrasion, harsh tecture of the printed products, and the like.

In accordance with the present invention there is provided a process of dyeing a product of a fiber blend consisting of from about 25 to 75 weight percent of acrylic fibers having substantially no dyesites for anionic dyes and, correspondingly, from about 75 to 25 weight percent of a cellulosic fiber, which process comprises: (1) printing said fiber product with a paste comprising an acid dye having a single sulfonic acid group and a ratio of inorganicity/organicity of less than 4 and a dye selected from direct and reactive dyes; and (2) steaming the printed fiber product to fix the dyes, the acrylic fiber being dyed with said acid dye and the cellulose fiber being dyed with said dye selected from direct and reactive dyes.

The present process provides products of the specified fiber blend that are uniform in desired colors of the fiber components and are free from defects such as spots, harsh texture, poor color fastness to abrasion, dull shades, instability of printing paste, precipitate formation, and the like. By proper selection of dyes employed, the blend components may be uniformly dyed the same or different colors, thus providing a multiplicity of effects.

In use of reactive dye in treating cellulose fibers, an alkali is generally employed therewith to accelerate the reaction. In the past, this use of alkali necessitated a separate alkali treatment of the fiber product, usually after printing the fiber product with the dye paste, to avoid instability problems of the paste. In the present process, however, it is desirable to add the alkali directly to the printing paste since instability problems do not result and the elimination of the separate step accelerates the process, which additionally effects improvements in dimensional stability and feel of the final fiber product.

The term "fiber products," as employed throughout the present specification and claims, is intended to mean woven or knit fabrics produced from yarns spun from blended fibers or blend-twisted from yarns of separate fiber types, as well as woven or knit fabrics arising from use of yarns of different fibers in the weaving process, i.e., a fiber blend results from the weaving patten. The product may also be a carpet, with fiber blends making up the pile, as well as non-woven fabrics. In all cases the products will, of course, contain the two specific fiber types enumerated.

The term "cellulosic fiber" as used throughout the present specification and claims is intended to mean a vegetable fiber such as cotton, hemp, ramie, jute, etc. as well as regenerated cellulose fibers such as rayon, cupraamonium rayon, and the like.

The term "acrylic fiber" as used throughout the present specification and claims is intended to mean fibers obtained from spinning homopolymers and copolymers containing acrylonitrile. Such polymers are those which contain at least 40 weight percent acrylonitrile or a mixture thereof. The polymers are substantially free from basic groups but contain acid groups such as sulfonic acid groups, carboxyl groups, etc. Typically, fibers such as acrylic monocomponent and composite such as Orlon, Creslan, and modacrylic fibers such as Dynel, may be employed, (Registered Trademarks).

As to the dyes used to dye the acrylic fiber component of the fiber products of the present invention, it is necessary to use acid dyes of which the ratio of inorganicity/organicity, as obtained by the method described in "The Kagaku-no-Rvoiki," Vol. 11, No. 10, pp. 719–725 (1957) (Japan), is less than 4 and which contain a single combined sulfonic acid group ($-SO_3X$, wherein X is hydrogen or a monovalent cation). If an acid dye not satisfying such requirements is used, it is impossible to dye the acrylic fiber component in a sufficient depth of color.

The calculation for obtaining the value of inorganicity/organicity is illustrated in the following, using C.I. Acid Orange 7 as an example.

C.I. Acid Orange 7 = 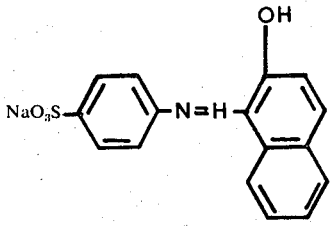

Organicity

| | | |
|---|---|---|
| Number of carbon atoms | = | 16 |
| 20 × 16 = 320 | | |

Inorganicity

| | | |
|---|---|---|
| $-SO_3Na$ = 250+500 | = | 750 |
| —OH | = | 100 |
| Naphthalene nucleus | = | 60 |
| —N=N— | = | 30 |
| Benzene Nucleus | = | 10 |
| | | 950 |

Ratio of Inorganicity/organicity = 950/320 = 3.0

As to the reactive or direct dyes used according to the present invention for dyeing cellulose fibers, any of those commercially available may be effectively used.

In preparing a printing paste for use in the present invention, any commercial paste-forming material may be used. Typically useful materials include sodium alginate, starch, processed starches, cellulosic semi-synthetic paste material, crystal gum, locust bean gum and modified products thereof, or emulsion pastes, i.e., solution of a paste material containing an emulsifying agent. Printing auxiliaries such as urea, etc, may be added to the printing paste as required.

In accelerating the reaction of reactive dyes with cellulose fibers, typical catalysts such as sodium bicarbonate, potassium carbonate, sodium carbonate, caustic soda, etc. may be used. It is generally preferred to add such catalyst to the dye paste immediately before use to shorten the process. However, it is also possible to treat the fiber product with such catalyst after printing.

The fiber products of the present invention are printed with the dye paste in accordance with standard procedures and then subjected to heat treatment with steam to fix the dyes. Desirably, the heat treatment is carried out at a temperature in the range of 100° to 115°C. for at least about 5 minutes. When the steam temperature is below that stated, dyeing of the acrylic fiber is unsatisfactory. When the temperature is above the range stated, it is difficult to dye the cellulose fiber component. To promote the effect of heat treatment, it is desirable to add to the printing paste from about 0.1 to 1.0 weight percent, based on the weight of said paste of a solvent for the acrylic fiber, such as ethylene carbonate, dimethylformamide, concentrated aqueous solutions of thiocyanate salts, etc.

The fiber product thus treated is then passed through the customary steps of soaping, water-washing, drying, etc. and is then finished in the final formed desired.

The invention is more fully illustrated by the examples which follow wherein all parts and percentages are by weight unless otherwise specifically indicated.

EXAMPLE 1

A knit fabric produced from blended yarn consisting of 50 parts of an acrylic fiber Exlan SK, containing no basic groups, and 50 parts of cotton was subjected to preliminary bleaching in anticipation for printing. A dye paste was prepared by adding 20 parts of sodium bicarbonate to a mixture consisting of 20 parts of a monosulfonic acid dye of inorganicity/organicity ratio 2.7 and having the formula:

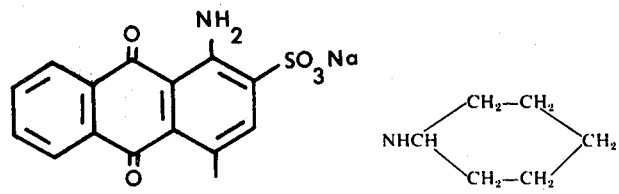

20 parts of reactive dye C.I. Reactive Blue 68, 20 parts of urea, 300 parts of hot water (50°–60°C.), 600 parts of 10% aqueous solution of sodium alginate, and 20 parts of water. The fabric was printed with the dye paste immediately after mixing in the sodium bicarbonate. The printed fabric was steamed at 110°C. for 15 minutes, and then soaped, water--washed, and dried. The printed fabric obtained exhibited a clear blue coloration in its fiber components, i.e., in both the acrylic and cellulose fiber components. No speckled color spots were observed and the fabric exhibited good color fastness and resistance to abrasion.

COMPARATIVE EXAMPLE A

The procedure of Example 1 was repeated in every material detail except that the acid dye was replaced by an equal quantity of one of an inorganicity/organicity ratio of 2.5 but containing two sulfonic acid groups and having the formula:

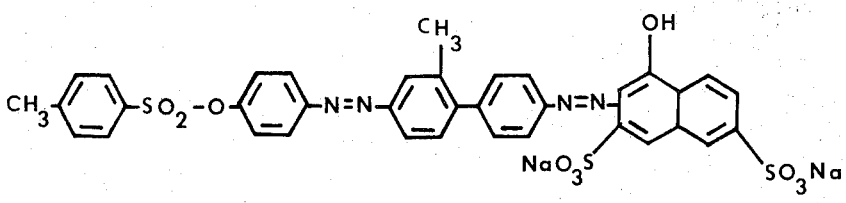

The printed fabric obtained had cotton fiber components dyed with a good blue color but had the acrylic fiber components substantially undyed. As a result, it was of poor merchandise value.

EXAMPLE 2

A woven fabric produced from a blended yarn consiting of 30 parts of rayon and 70 parts of an acrylic fiber having only acid groups as dye-sites was desized preparatory to printing. A printing paste was composed of 30 parts of a monosulfonic acid dye having an inorganicity/organicity ration = 2.5 and a formula of:

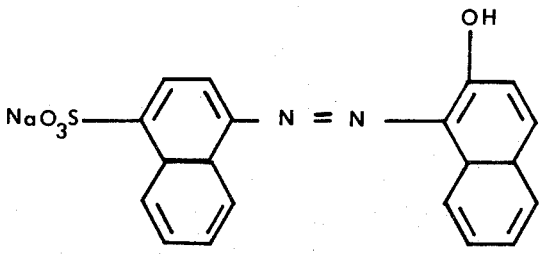

15 parts of C.I. Reactive Red 105, 20 parts of urea, 300 parts of hot water, 600 parts of a 10% aqueous solution of sodium alginate, and 15 parts of water. To the paste was added 20 parts of sodium bicarbonate to a uniform consistency. The fabric was printed and steamed at 110°C. for 5 min., after which it was soaped, water-washed, and dried. The fabric obtained was of uniform red color both in the acrylic and rayon components. Colorfastness and resistance to crocking were excellent.

COMPARATIVE EXAMPLE B

Following the procedure of Example 2 in every material detail a printed fabric was prepared with the exception that as the acid dye, there was used one containing 3-sulfonic acid groups, having an inorganicity/organicity ratio of 6.3, and having a formula:

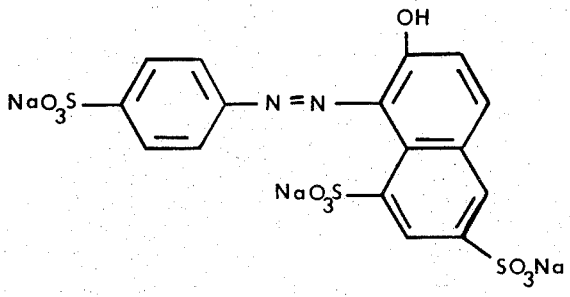

The acrylic fiber remained undyed and the fiber product had a poor merchandise value.

EXAMPLE 3

A knit fabric of single stiches produced from the yarn used in Example 1 was prepared for dyeing by preliminary bleaching. The fabric was printed as in Example 2 except that C.I. Reactive Yellow 57 was used in place of the reactive dye of Example 2 and the amounts of reactive dye and acid dye were 20 parts each.

The resulting fabric was uniform in dyeing, providing a very interesting mixed tone of red and yellow, free of any specks. Colorfastness was good.

EXAMPLE 4

The procedure of Example 1 was followed in every material detail except that there was used a printing paste of 15 parts of the acid dye of Example 1, 10 parts of C.I. Direct Blue 203, 20 parts of thiodiethylene glycol, 30 parts of urea, 325 parts of hot water, and 600 parts of an 11% aqueous solution of a paste material identified as Indalca ABV.

The resulting fabric was of excellent uniformity in blue shade among the fiber components and had an excellent touch.

EXAMPLES 5–8

The procedure of Example 1 was carried out in every material detail except that for the acid dye therein, there was substituted an equal amount of the dye identified below:

Example 5 — C.I. Acid Red 9, i/0=2.5
Example 6 — C.I. Acid Blue 62, i/0=2.8
Example 7 — C.I. Acid Blue 40, i/0=3.0
Example 8 — C.I. Acid Orange 7, i/0=3.0
(i/0 = ratio of inorganicity/organicity)

There were obtained monocolored and multicolored fiber products which had good color fastness and high merchandise value. The printing paste, in each instance, was very stable without precipitation. Consequently, no specks were found on the printed article.

We claim:

1. A process for dyeing a product of a fiber blend consisting of from about 25 to 75 weight percent of acrylic fibers having substantially no dyesites for anionic dyes and, correspondingly from about 75 to 25 weight percent of a cellulosic fiber, which process comprises: (1) printing said fiber product with a paste comprising an acid dye having a single sulfonic acid group and a ratio of inorganicity/organicity of less than 4 and a dye selected from direct and reactive dyes; and (2) steaming the printed fiber product to fix the dyes, the acrylic fiber being dyed with said acid dye and the cellulose fiber being dyed with the dye selected from reactive and direct dyes.

2. The process of claim 1 wherein steaming is at a temperature of 100° to 115°C. for at least about 5 minutes.

3. The process of claim 1 wherein the cellulosic dye is a direct dye.

4. The process of claim 1 wherein the cellulosic dye is a reactive dye.

5. The process of claim 1 wherein subsequent to steaming, the fabric is subject to soaping, water-washing and drying.

6. The process of claim 1 wherein the product is a knit fabric.

7. The process of claim 1 wherein the product is a woven fabric.

8. The process of claim 4 wherein the paste used to print the fiber product contains an alkali incorporated therein.

9. The process of claim 1 wherein the fiber blend is of 50 weight percent acrylic and of 50 weight percent cellulosic fibers.

10. The process of claim 1 wherein the fiber blend is of 30 weight percent rayon and 70 weight percent acrylic fiber.

* * * * *